US008876180B2

(12) United States Patent
Kirby et al.

(10) Patent No.: US 8,876,180 B2
(45) Date of Patent: Nov. 4, 2014

(54) WASTE REMOVAL SYSTEM

(75) Inventors: Simon Kirby, Malvern Wells (GB); Stuart Mathew Kirby, Malvern Wells (GB)

(73) Assignee: MaFace Solutions Ltd (GB)

( * ) Notice: Subject to any disclaimer, the term of this patent is extended or adjusted under 35 U.S.C. 154(b) by 85 days.

(21) Appl. No.: 13/579,177

(22) PCT Filed: Feb. 16, 2011

(86) PCT No.: PCT/GB2011/050304

§ 371 (c)(1),
(2), (4) Date: Aug. 15, 2012

(87) PCT Pub. No.: WO2011/101671

PCT Pub. Date: Aug. 25, 2011

(65) Prior Publication Data

US 2012/0304406 A1 Dec. 6, 2012

(30) Foreign Application Priority Data

Feb. 16, 2010 (GB) ..... 1002633.4

(51) Int. Cl.
*A01K 29/00* (2006.01)
*E01H 1/12* (2006.01)

(52) U.S. Cl.
CPC ..... *E01H 1/1206* (2013.01)
USPC ..... 294/1.3

(58) Field of Classification Search
USPC ..... 294/1.3–1.5; 119/161, 867; 15/257.1–257.7
See application file for complete search history.

(56) References Cited

U.S. PATENT DOCUMENTS

| | | | | |
|---|---|---|---|---|
| 3,139,299 | A * | 6/1964 | Bowen | 294/1.4 |
| 4,148,513 | A * | 4/1979 | Gagne | 294/1.4 |
| 4,368,907 | A * | 1/1983 | Ross | 294/1.4 |
| 4,383,710 | A | 5/1983 | Fehr | |
| 4,741,566 | A | 5/1988 | Byung-Do et al. | |
| 6,478,351 | B1 * | 11/2002 | Nelson | 294/1.4 |
| 8,550,511 | B2 * | 10/2013 | Baars | 294/1.3 |

FOREIGN PATENT DOCUMENTS

| | | |
|---|---|---|
| DE | 2 306 593 | 8/1974 |
| DE | 10 2008 028 920 A1 | 1/2009 |

OTHER PUBLICATIONS

Written Opinion of the International Searching Authority; Mailing date: Unknown; International Application No. PCT/GB2011/050304; International Filing Date: Feb. 16, 2011.

Notification Concerning Transmittal of International Preliminary Report on Patentability (Chapter I of the Patent Cooperation Treaty); Mailing date: Aug. 30, 2012; International Application No. PCT/GB2011/050304; International Filing Date: Feb. 16, 2011.

* cited by examiner

*Primary Examiner* — Stephen Vu
(74) *Attorney, Agent, or Firm* — Hovey Williams LLP

(57) ABSTRACT

A waste removal device includes a body, a paddle, and a collection chamber. The paddle is drivable to deliver waste from an area to be cleaned to the collection chamber. The waste removal device further includes a fluid delivery device arranged to deliver a fluid to the area to be cleaned. A lever may be actuated to drive the paddle and an optional brush or other secondary means, which scoop and clean pet waste from a surface. Upon activating the paddle, a water sanitation system may engage and deliver sanitation fluid both onto the area to be cleaned and onto internal mechanisms of the device.

15 Claims, 12 Drawing Sheets

WASTE REMOVAL SYSTEM

RELATED APPLICATIONS

This is a national stage application under 35 U.S.C. §371 of International Application No. PCT/GB2011/050304, filed 16 Feb. 2011, which claims priority from United Kingdom Application No. 1002633.4, filed 16 Feb. 2010. The disclosures of the above-referenced applications are hereby incorporated by reference in their entirety.

BACKGROUND

1. Field

This invention relates to the collection and disposal of waste. In particular, the invention relates to a self contained unit for cleanly and efficiently disposing of waste of any kind, including pet waste, in a clean and safe manner without requiring direct contact between the user and the waste, and also creating a barrier to the sight and odour of the waste during the cleaning operation.

2. Discussion of Prior Art

Pet waste comes in many shapes, sizes and textures. Whilst there are a number of collection and disposal devices on the market, removal usually involves close and unpleasant contact with the waste. Often residual waste remains on the grass or pavement causing health risks such as toxocariasis which has been known to cause partial blindness. Some devices rely on transferring the waste between device and bag which, once again, involves close handling of the waste.

SUMMARY

To address the deficiencies of the prior art, the present invention provides a pet waste removal device comprising:

a body;

a paddle; and a collection chamber;

the paddle being drivable to deliver waste from an area to be cleaned to the collection chamber; and further comprising a fluid delivery device arranged to deliver a fluid to the area to be cleaned.

The combination of a drivable paddle and a fluid delivery device arranged to deliver a fluid to the area to be cleaned results in an improved pet waste cleaning system improving hygiene and safety of the user and fellow occupants/users of the area being cleaned.

The pet waste removal device may further comprise a paddle driving arrangement, arranged to drive the paddle, which allows the paddle to be drive without direct user contact with the paddle.

The paddle driving arrangement may be arranged to activate the fluid delivery device. This results in a single user action operating both the paddle and the fluid delivery device, making use quicker, more efficient and reducing the likelihood of a user error resulting in the application of fluid being omitted from the cleaning operation.

The paddle driving arrangement may be a mechanism requiring no external power to drive the paddle and fluid delivery device, resulting in low running costs and no need for a power source or supply in or connected to the device.

The mechanism may be a lever arranged to drive the paddle, a lever can result in a specific chosen mechanical advantage or a particularly desirable ratio of operator movement to paddle movement. This can ensure a more ergonomic use for the user.

The lever may comprise an elbow arm. This can help to translate a substantially vertical movement to a substantially horizontal movement efficiently.

The fluid delivery device may be arranged to deliver fluid to the paddle and to the area to be cleaned. This results in the fluid delivery device performing a double function of cleaning/disinfecting both the device and the area to be cleaned resulting in a more efficient cleaning operation.

The body may comprise an enclosure arranged to be placed over the area to be cleaned during operation of the paddle and/or the liquid delivery device. When waste is disturbed, the experience can be unpleasant for the user and further odours may be released. Carrying out the cleaning operation in a substantially enclosed space reduces the exposure of the user to unpleasant sights and odours associated with the cleaning of waste, in particular pet waste.

The body may comprise an opening defining the area to be cleaned. In this way, the body can define the enclosure and an opening in the body allows the cleaning operation to take place while the user is isolated from the operation by the body.

The device may further comprise a secondary cleaning portion, arranged to follow the paddle to remove waste from the area to be cleaned. This provides a double cleaning action to improve the effectiveness of the waste cleaning operation.

The secondary cleaning portion may comprise any one of: brushes, a soft resilient over-moulding, sponge or a foam moulding, which are particularly suited to improving the cleaning operation.

The paddle may induce a scooping effect. This scooping effect can help to lift the waste from the ground, resulting in a more efficient cleaning operation as compared to devices having a substantially linear stroke.

The paddle may be arranged to be driven through a stroke from a first point to a second point, passing over the area to be cleaned.

The stroke may comprise:

a first part, along which an edge of the paddle nearest to the area to be cleaned travels substantially parallel to the area to be cleaned; and a second part along which an edge of the paddle nearest to the area to be cleaned travels away from the area to be cleaned to lift waste away from the area to be cleaned.

The stroke may further comprise a stage in which the edge of the paddle nearest to the area to be cleaned approaches the area to be cleaned. This helps the edges to get under the waste before lifting it away from the ground of other surface to be cleaned.

The scooping effect may comprise a combination of linear movement and rotational movement of the paddle. Substantially linear motion can help to maximise the area cleaned in one stroke, while the rotational action assists the lifting of the waste from the area being cleaned.

The paddle may be driven along at least one pathway arranged to create the scooping effect. The paddle comprises pathway engagement means to engage with the pathway(s).

The pet waste removal device may further comprise a first pathway, and a second pathway arranged between the first pathway and the area to be cleaned. The arrangement of two pathways as described is an efficient way of allowing independent relative movement of two parts of the paddle to create a motion of the paddle as described above.

The paddle may comprise first and second engagement means arranged to engage the first and second pathways, respectively, which can allow the movement of the respective parts of the paddle to be different from one another.

A pet waste removal device may be provided comprising:

a body;

a paddle; and a collection chamber;

the paddle being drivable to deliver waste from an area to be cleaned to the collection chamber;

wherein driving the paddle induces a scooping effect in the paddle. The scooping effect has the advantages described above and may be used independently of the fluid delivery device if so desired.

A pet waste removal system may be completely sealed, using an elbow arm mechanism to drive a paddle and brush or other secondary cleaning means horizontally, to make non-evasive contact with the surface whilst scooping and brushing any waste into a collection chamber.

Upon depressing the lever, the lever may drive the paddle and brush, and also engage a water sanitation system that squirts fluid onto the affected area, paddle and brush.

Upon collecting pet waste in a collection chamber the device may be automatically emptied via a docking station into a biodegradable tank.

The device may be arranged to be able to collect multiple amounts of waste before needing to be emptied in a waste bin or a docking station.

The invention can therefore provide a device in the form of a sealed handheld unit, which is placed over the waste, and which is sealed, in so far as when placed over the waste, the waste is enclosed in a cavity formed between the ground and the device. A lever is depressed which drives a paddle across the area of waste, flipping the majority of the waste into a collection chamber, the paddle may then be followed by brushes, or another secondary cleaning portion, which follows the paddle to remove the final traces of waste. In conjunction with this, depressing the lever also operates a liquid jet system that distributes sanitisation fluid onto the waste area and mechanisms within the device. Upon collection of the waste, the device may then be returned to an optional docking station, where the waste may be automatically released into a biodegradable tank or disposable bag. Alternatively, the waste may be held in a bag within the container which is manually removed by the user. Opening the device may automatically close the bag.

Once positioned over the waste, the device will remove the waste from both sight and smell of the user removing the main unpleasant factors which a user generally experiences when cleaning any waste, namely, those of the sight and smell of the waste.

The lever can be depressed as many times as necessary to ensure complete removal and sanitisation of the area.

The device can collect waste on multiple occasions in multiple amounts before needing to be emptied.

The device mechanisms are self cleaning and do not require removal and extra cleaning.

Preferably, the device is docked in a biodegradable tank that is easily submerged in the garden, requiring no user contact with the waste.

BRIEF DESCRIPTION OF THE DRAWING FIGURES

Alternative embodiments of the invention will now be described with reference to the accompanying drawings, in which.

DETAILED DESCRIPTION OF THE PREFERRED EMBODIMENTS

Figure 1:
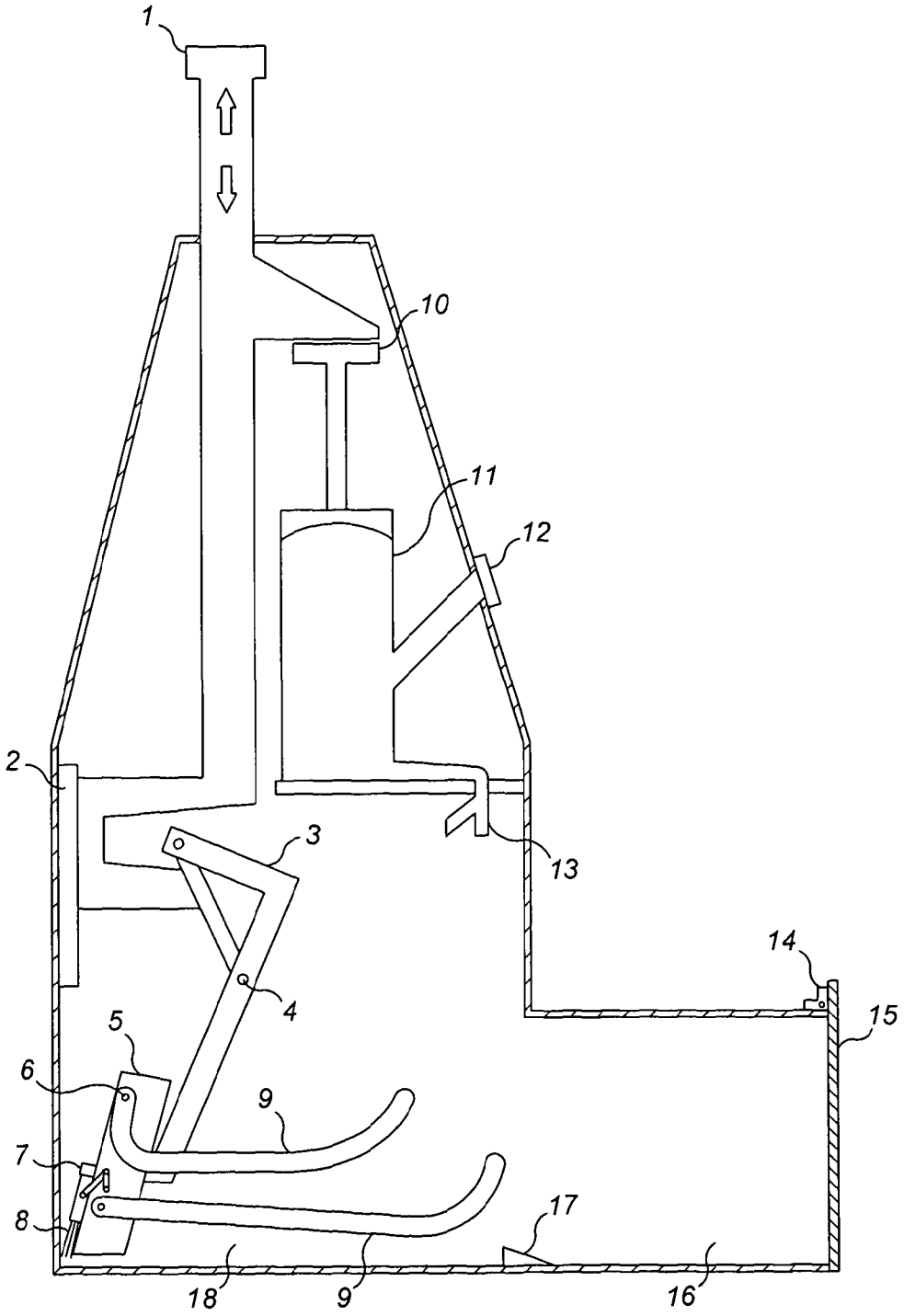
FIG. 1 shows a first embodiment of the invention.

In FIG. 1, a lever 1 is depressed to operate the device. A water sanitation tank 11 is activated by a plunger 10 as the lever 1 is pushed down. A refill plug 12 is provided for adding water and sanitation fluid. Directional water jets 13 are provided to dispense water and/or sanitation fluid to onto the affected area and mechanisms. An elbow arm mechanism 3 is used to drive the paddle 5 and the brush 8 that follow horizontally along tracks 9.

Figure 2:
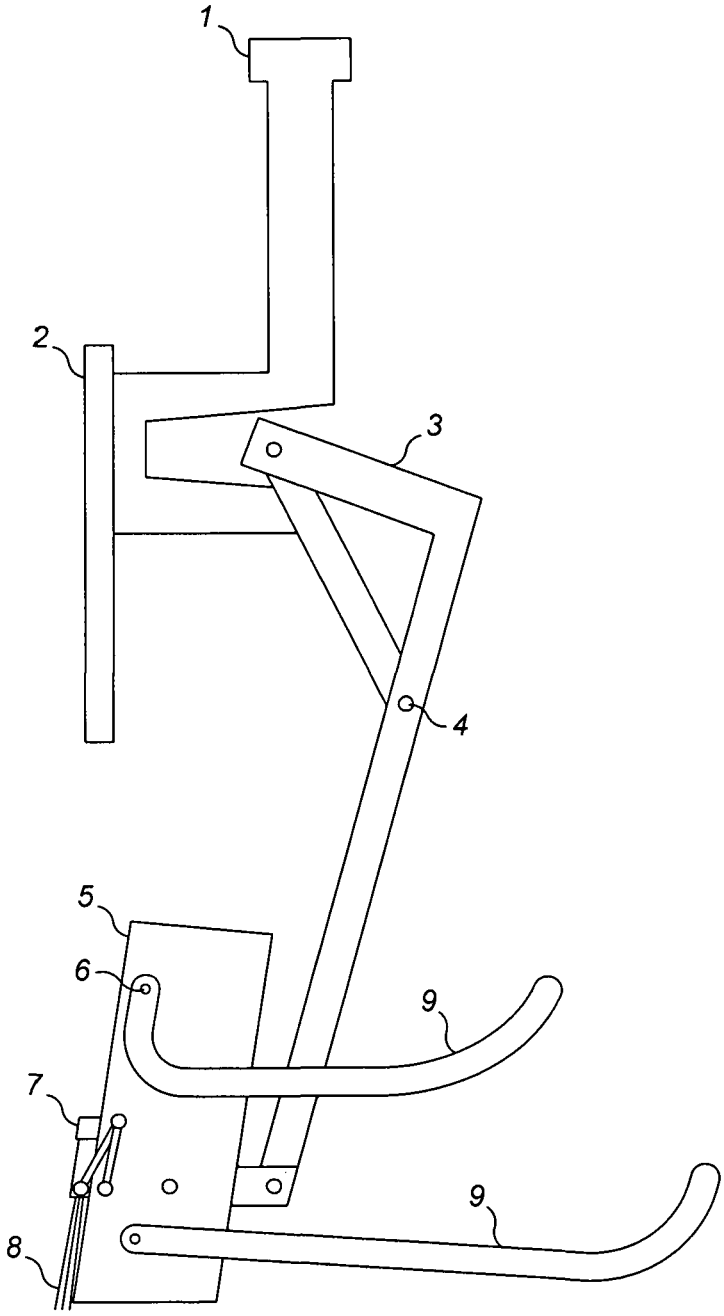
FIG. 2 shows an elbow arm mechanism driven by a lever and connected to the paddle and brush of the present invention.

With reference to FIG. 2, it can be understood that when the lever 1 is pushed down, it follows its runner 2 and drives the elbow arm mechanism 3. The elbow arm mechanism 3 remains fixed at the pivot point 4 and forces the paddle 5 which is joined by a swing arm connector 7 to a brush 8 along the tracks 9 to create a horizontal scoop from left to right.

Figure 3A:
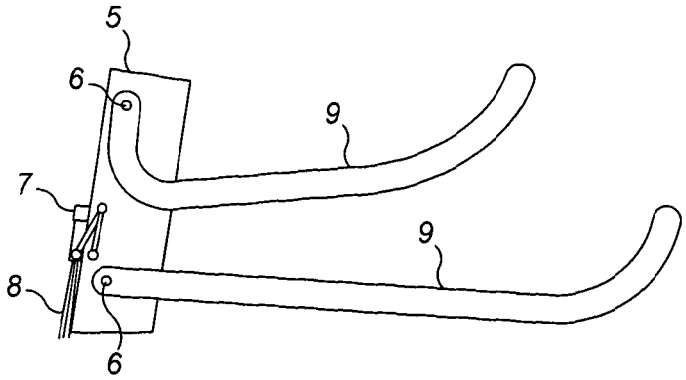
FIG. 3 shows three positions of the paddle and brush as driven by the lever.

FIG. 3*a* shows the paddle 5 and brush 8 in the start position.

Figure 3B:
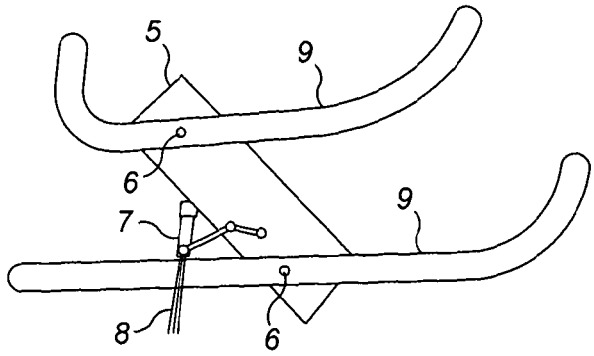

FIG. 3*b* shows the paddle 5 and brush 8 in mid motion moving along its tracks 9. The paddle remains connected to the tracks by two track bolts 6. The brush 8 follows behind the paddle 5 by a distance of approximately 6 cm and is fixed to the paddle 5 by a swing arm connector 7.

Figure 3C:
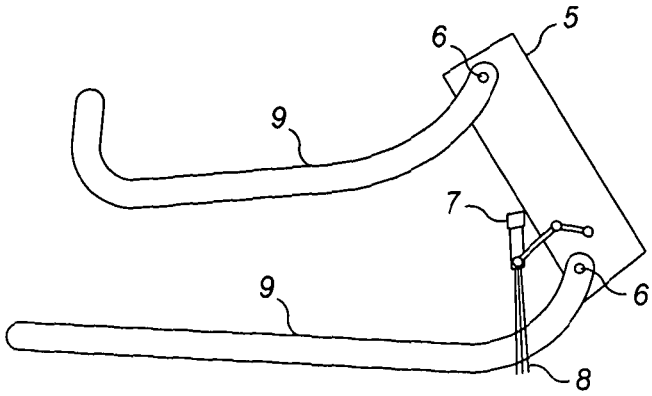

FIG. 3*c* shows the final position of the paddle 5 and brush 8 after it has moved through and collected the waste and brushed clean the area. Pulling the lever 1 (shown in FIGS. 1 and 2) up returns it to its start position and drives the paddle 5 and brush 8 back along its tracks 9 to its start position as shown in FIG. 3*a*.

Figure 4:
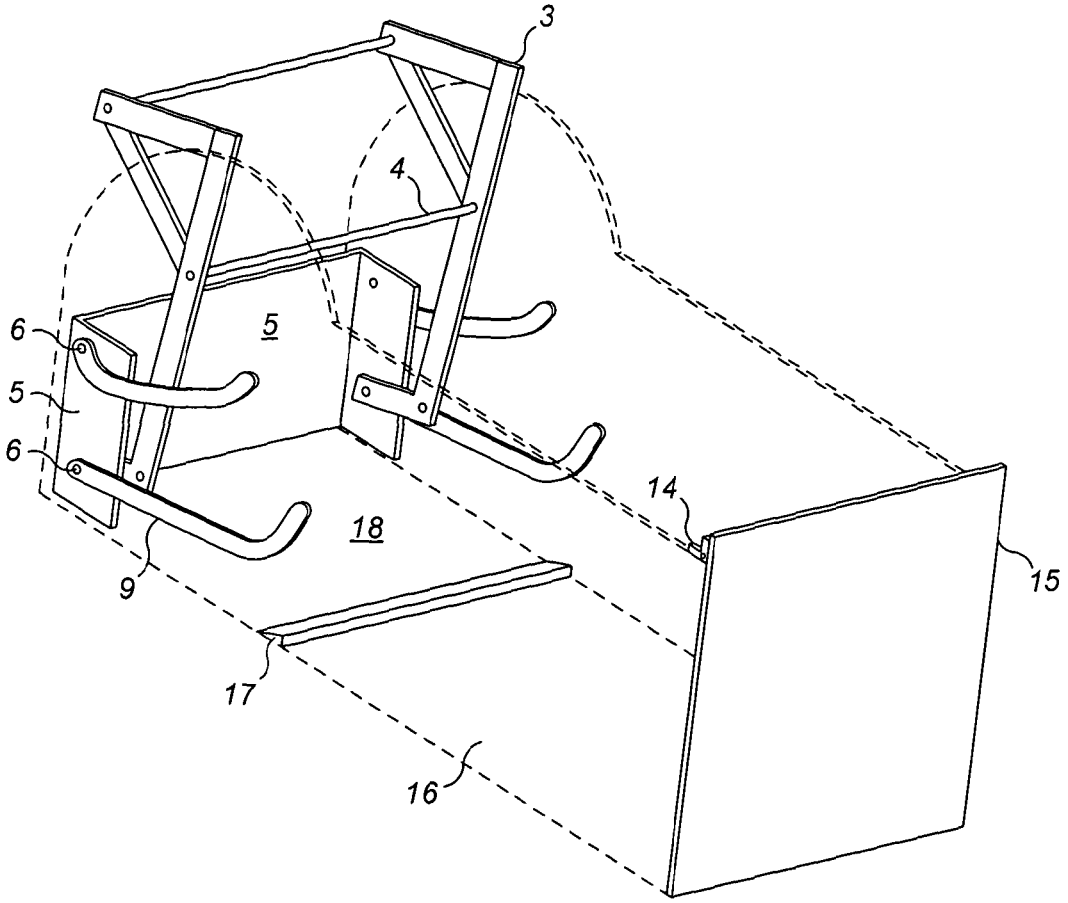
FIG. 4 illustrates a three dimensional view of the main mechanism that scoops and brushes the waste into a collection chamber.

FIG. 4 shows a three dimensional view of how the paddle 5 is driven along the tracks 9 across the target area 18, due to downward force placed on the elbow arm mechanism 3 by the lever 1 (shown in FIGS. 1 and 2). The downward force is redirected via the fixed pivot point 4 which drives the paddle 5 and brush 8 (shown in FIGS. 1, 2 and 3) from left to right creating a scooping effect. As can be seen in the figures, the tracks each define a path along which connecting points of the paddle can travel in a substantially horizontal direction. The tracks have a first end at which the paddle is located before the lever is activated and a second end at which the paddle is located after the level is actuated. The tracks comprise an inclined portion toward the second end, configured to deflect a bottom part of the paddle in a direction away from the area to be cleaned in order to scoop the waste away from the area to be cleaned and into the collection chamber. After collection of the waste, pulling the lever 1 (shown in FIGS. 1 and 2) up creates the opposite effect and returns the paddle 5 and brush 8 to its start position.

Figure 5:
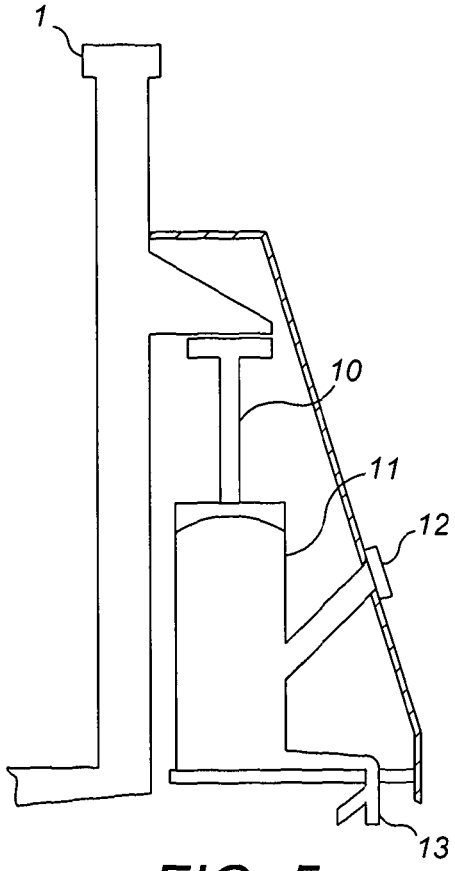
FIG. 5 shows a simple water pump system that may be used to direct water or sanitation fluid onto the affected area, paddle and brush.

FIG. 5 illustrates the relationship between the lever 1 and the plunger 10. When the lever is depressed, it drives the water pump handle, or plunger, 10, which creates pressure in the tank 11 forcing water through the water jets 13 and onto the affected area, paddle and brush. The tank 11 can be refilled with water or other sanitation fluid through the sealable plug 12.

Figure 6:
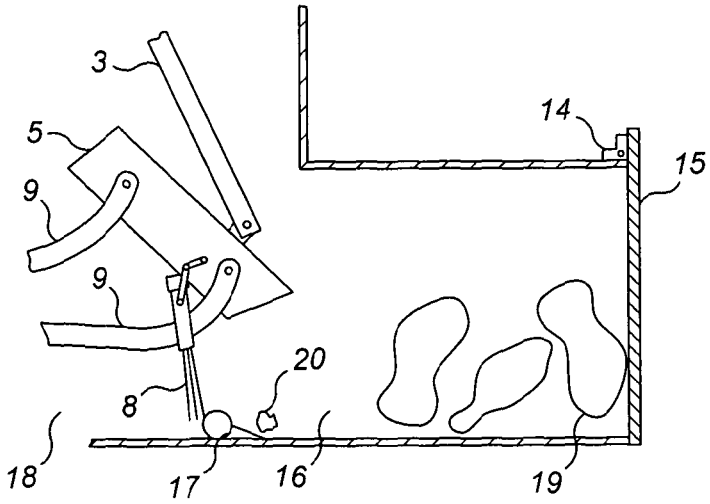
FIG. 6 shows the collection chamber receiving waste from the paddle.

FIG. 6 shows the waste collection chamber 16 after the paddle 5 and brush 8 has cleared the target area 18 and flipped the larger waste 19 from the paddle 5 and the remaining residual waste 20 from the brush 8. The waste remains in the collection chamber 16 until it is placed in the docking station or removed to a bag, or removed within a removable bag provided in the collection chamber. The docking area may be shaped to push against the top lip of the door 15 and, through a sprung hinge 14, may automatically open the door 15 to release the waste into a bag or biodegradable tank. Lip 17 is located between the area to be cleaned and the collection chamber and helps to prevent waste from falling back to the area to be cleaned once it has been delivered to the collection chamber by the paddle. The scooping motion of the paddle helps to provide an upward motion to the waste to assist it over the lip 17.

Figure 7:
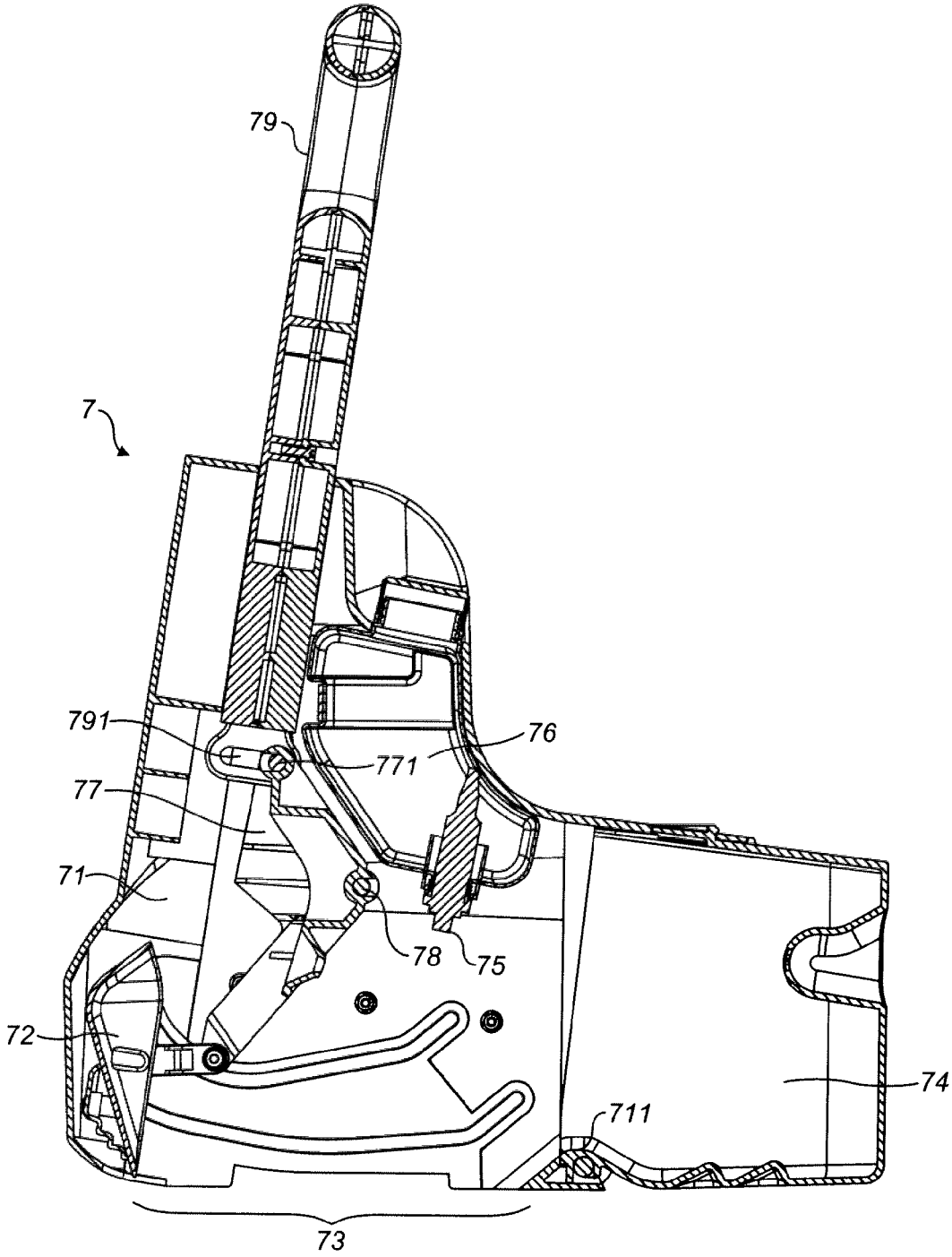
FIG. 7 shows a side view of a second embodiment of the present invention.

A second embodiment of the invention is described in relation to FIGS. 7 to 16. FIG. 7 shows a pet waste removal device 7 having a body 71 and a paddle 72. The paddle is driveable from left to right in the figure to deliver waste from an area to be cleaned, located in an opening in the bottom of body 71 at the bottom of the figure, to a collection chamber 74. The device 7 further comprises a fluid delivery device 75 which is arranged to deliver a fluid to the area to be cleaned 73. The fluid delivery device 75 may be connected to a fluid chamber 76. Fluid container 76 may comprise an opening having a cap which may be opened and closed for refilling and sealing the fluid within the chamber 76. The fluid delivery device and its chamber are optionally included in the device and can be removed without substantially changing the function of the remaining features of the invention in either embodiment. A paddle activation arrangement is arranged to drive the paddle to deliver waste from the area to be cleaned 73 to the connection chamber 74. The paddle activation arrangement may be arranged to activate the fluid delivery device in addition to driving the paddle. In this particular embodiment, the paddle activation arrangement is provided in the form of a mechanism comprising a lever 77, which is arranged to rotate about a pivot 78. The lever is connected to a handle 79, which is arranged to impart motion to the lever when the handle is actuated, thus actuating the lever to rotate about pivot 78. An engagement point 791 is provided in handle 79. The engagement point 791 may be a slot which allows a lever engagement point 771 of the lever 77 a degree of freedom of movement relative to handle 79. The paddle activation arrangement comprising lever 77 is arranged to both drive the paddle 72 and to activate the fluid delivery device 75, as will be described in more detail in relation to later figures.

Figure 8:
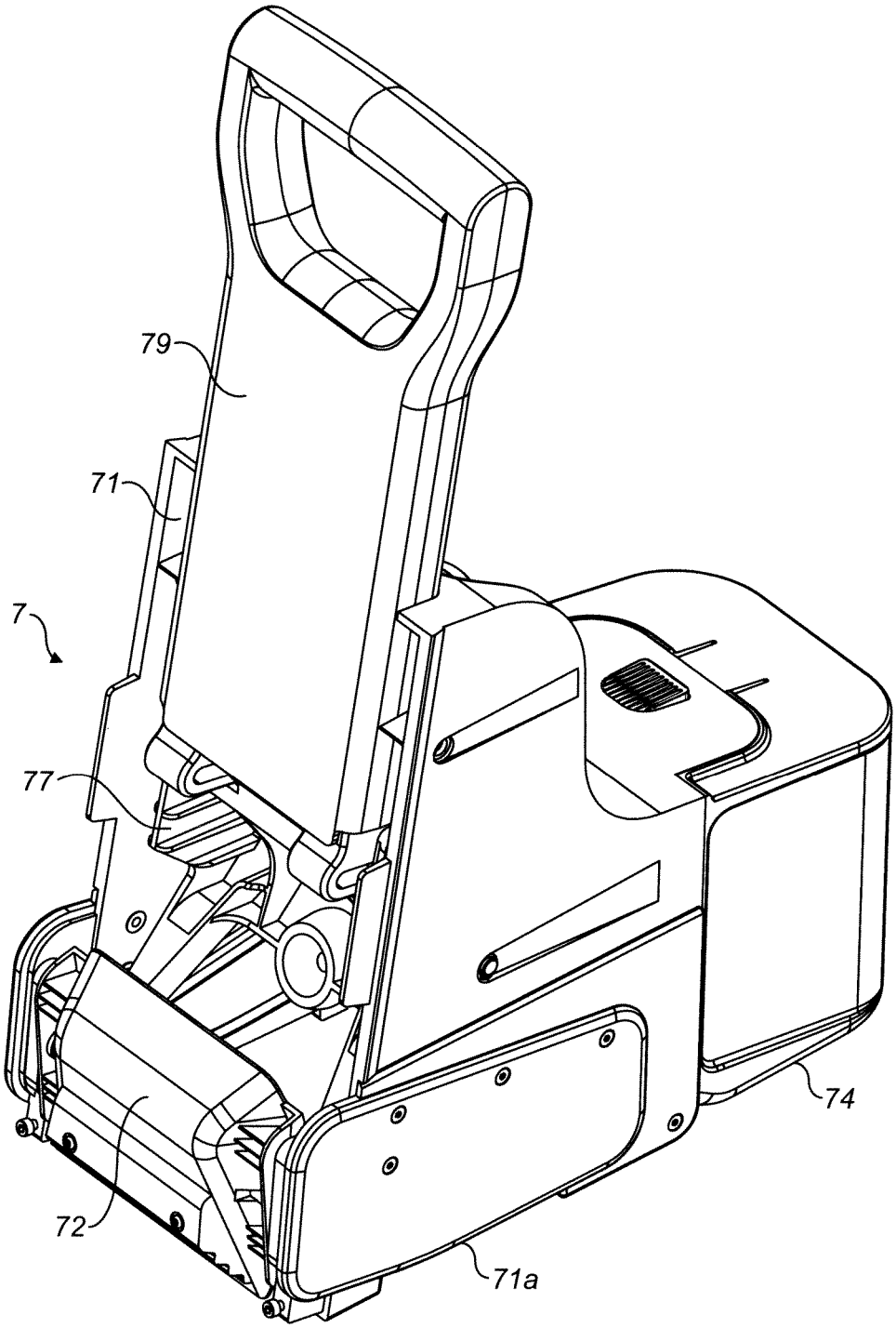
FIG. 8 shows a partially transparent perspective view of the present invention.

FIG. 8 shows a perspective view of pet waste removal device 7, which comprises a body 71, a paddle 72, a paddle activation arrangement comprising a lever 77, a handle 79, a fluid chamber 76 and a collection chamber 74. Body 71 is shown in transparent illustration in FIG. 8 to illustrate the inner parts. Body 71 may define an enclosure which substantially surrounds the paddle activation arrangement and the area to be cleaned. The area to be cleaned 73 is defined by an opening in the bottom of body 71, surrounded by sides of the body 71*a* and a lip 711 (shown in FIG. 7), which is located between the area to be cleaned 73 and the collection chamber 74. The lip 711 creates a partial barrier between the area to be cleaned 73 and the collection chamber 74, which can help to prevent waste from falling from collection chamber 74 back into the area to be cleaned after driving of the paddle 72 toward collection chamber 74 to deliver waste to the collection chamber.

Figure 9:
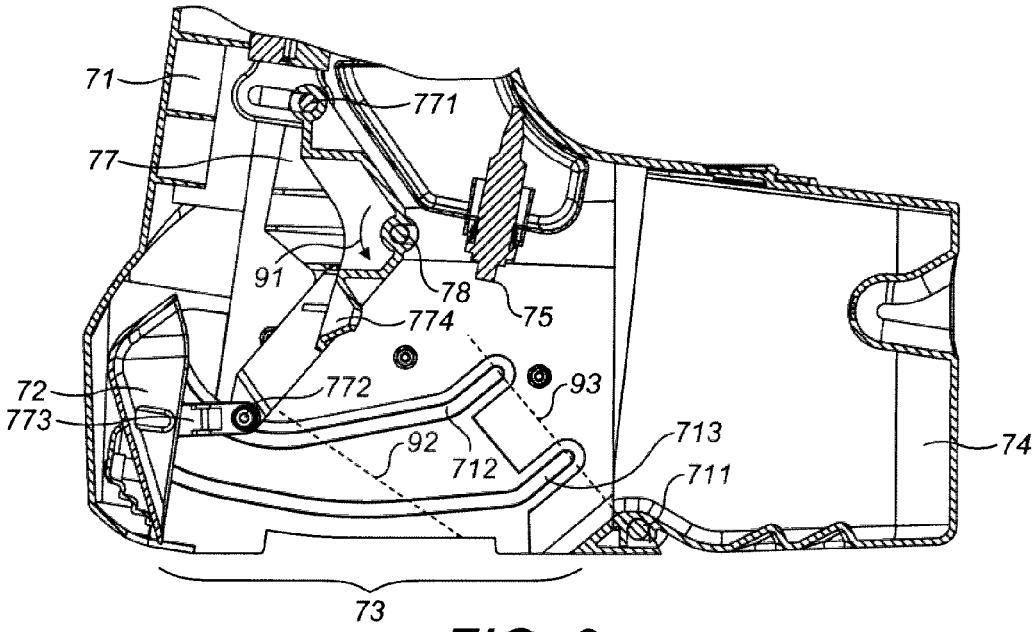
FIG. 9 shows a view of internal components of a paddle driving arrangement of the present invention.

FIG. 9 illustrates the paddle activation arrangement in greater detail. Lever 77 is an elbow arm, arranged to rotate about pivot point 78. As can be seen from the preceding figures, imparting a linear motion to handle 79 imparts rotation to the lever 77 in the direction of arrow 91. A second engagement point 772 of lever 77 is connected to paddle 72 such that rotational motion of lever 77 is translated to a partially linear motion of paddle 72, in a direction from the area to be cleaned 73 to collection chamber 74. Lip 711 of body 71 is arranged between the area to be cleaned 73 and the collection chamber 74. In order to encourage waste over lip 711, it is necessary to impart a scooping motion to paddle 72. In addition to delivering the waste to be delivered over the lip 711, imparting the scooping motion can improve the efficiency of paddle 72 in removing waste from the area to be cleaned 73.

The scooping motion provided to the paddle as it moves over the area to be cleaned 73 is a non-linear movement. The motion of the paddle comprises a component of rotation of the paddle relative to the area to be cleaned and to the body of the waste removal device. The scooping motion may also comprise a component of relative movement toward and away from the area to be cleaned in a direction perpendicular to the area to be cleaned 73, to lift waste from the area to be cleaned over the lip 711 and into to collection chamber 74.

In order to provide this scooping motion in the present invention, the body 71 is provided with a plurality of predefined paths along which the paddle moves when driven. The body comprises a first pathway 712 and a second pathway 713 arranged between the first pathway 712 and the area to be cleaned 73. The paddle comprises pathway engagement means 721 and 722 (shown in FIG. 10), arranged to engage with pathways 712 and 713. The pathways may take the form of slots provided in body 71 and the engagement means may be protrusions arranged to engage with those slots. Any other means of guiding engagement portions 721 and 722 along the pathways may be provided. A lever engagement point 723 (shown in FIG. 10) is provided on paddle 72, which is connected to lever 77. An intermediate connecting member 773 may be provided to allow some relative movement between lever 77 and paddle 72.

Pathways 712 and 713 are arranged to provide different non-parallel paths for engagement points 721 and 722, such that as the paddle 72 travels along the pathways, it is rotated relative to the area to be cleaned 73. Further, during movement along the pathways, relative movement of the paddle 72 towards and away from the area to be cleaned is provided. In particular, towards the end of the pathways 712 and 713, a component of the movement of paddle 72 is in a direction substantially perpendicular to the area to be cleaned. Where the area to be cleaned is substantially horizontal, for example on the ground, this results in an upward motion, which lifts waste away from the area to be cleaned and further helps to deliver the waste to the collection chamber 74 over lip 711.

The first pathway has a first part angled towards the area to be cleaned, a central part providing motion to the paddle substantially parallel with the area to be cleaned, and a final part providing motion away from the area to be cleaned. The second pathway 713 has a similar series of parts angled toward, substantially parallel with and away from the area to be cleaned, but the angles relative to the area to be cleaned are smaller than those provided for the first pathway. These differing paths for the first and second pathways provide a degree of rotation to the paddle 72 as it is driven along the pathways. Relative positions 92 and 93 of the paddle are illustrated by straight lines depicting different locations and orientations of the paddle as it travels along pathways 712 and 713.

A fluid delivery device engagement portion 774 is provided, such that when lever 77 rotates about pivot point 78, the engagement portion 774 engages with fluid delivery device 75 to activate the fluid delivery device. Engagement portion 774 may comprise an opening through which fluid delivery device 75 delivers fluid. Engagement portion 774, which engages with fluid delivery device 75 to activate the fluid delivery device. This activation is optionally carried out toward the end of the delivery stroke of the paddle 72. Fluid delivery device 75 may be activated by pressure imparted upon it by the engagement portion 774. This action may impart a pumping action to the fluid delivery device, or may alternatively activate a switch or lever or other actuating means to initiate the delivery of fluid to the paddle 72 and/or the area to be cleaned 73. It will be appreciated that when the paddle is in position 93 at the end of its driving stroke, a proportion of the fluid delivered by the fluid delivery device 75 is delivered to the paddle 72, while a proportion of it is delivered past and around the paddle to arrive at the area to be cleaned 73. In this way, a single activation can both drive the paddle 72 and activate the fluid delivery device 75 to deliver a cleaning or sanitising fluid to both the area to be cleaned and the paddle, reducing the burden on the user for multiple actions.

It will be appreciated that the way in which the paddle activation arrangement functions is essentially the same for both the first and second illustrated embodiments. However, other paddle activation arrangements may be envisaged, where electrical or other mechanical arrangements may be used to drive the paddle 72 and to actuate fluid delivery device 75.

Figure 10:
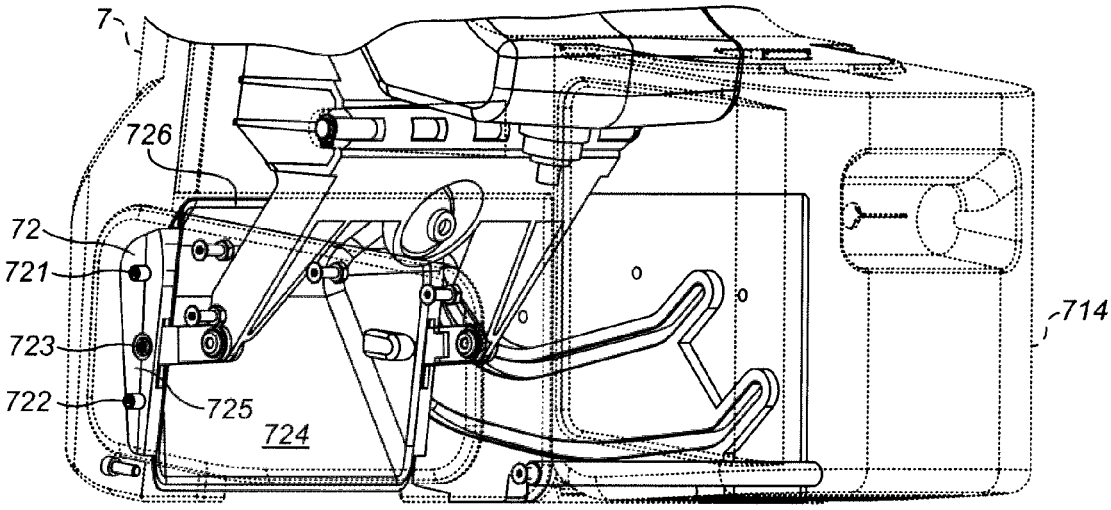
FIG. 10 shows the paddle and driving arrangement from a second perspective.

FIG. 10 shows a further cut-away view of the waste removal device. It can be seen that paddle 72 has a major panel 724, which is flanked by sides 725 and a rear part 726, which help to contain the waste as it is delivered to the connection chamber 74.

Figure 11:
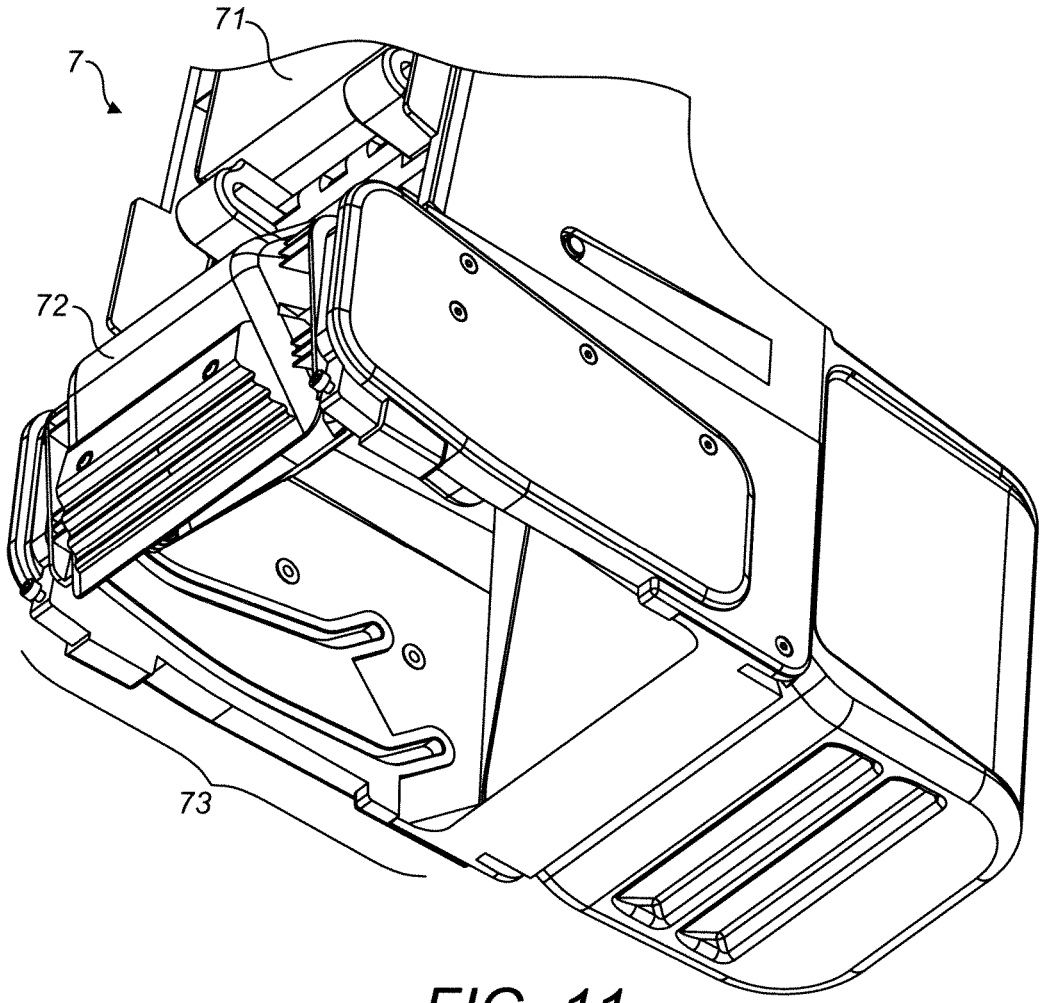
FIG. 11 shows the paddle and driving arrangement from a third perspective.

FIG. 11 shows the waste removal device viewed from an angle in the direction of the opening 73 in the body 71 of the device, which defines the area to be cleaned 73. A secondary cleaning portion 727 is arranged to follow the paddle, which may comprise brushes, foam, a rubber mould, a soft resilient over-moulding, sponge, a foam moulding or any other resilient sweeping means, arranged to sweep up parts of waste not collected by the paddle. The secondary cleaning portion 727 may be integral with the paddle.

The collection chamber may be removable, as will now be described in relation to FIGS. 12 to 18.

Figure 12:
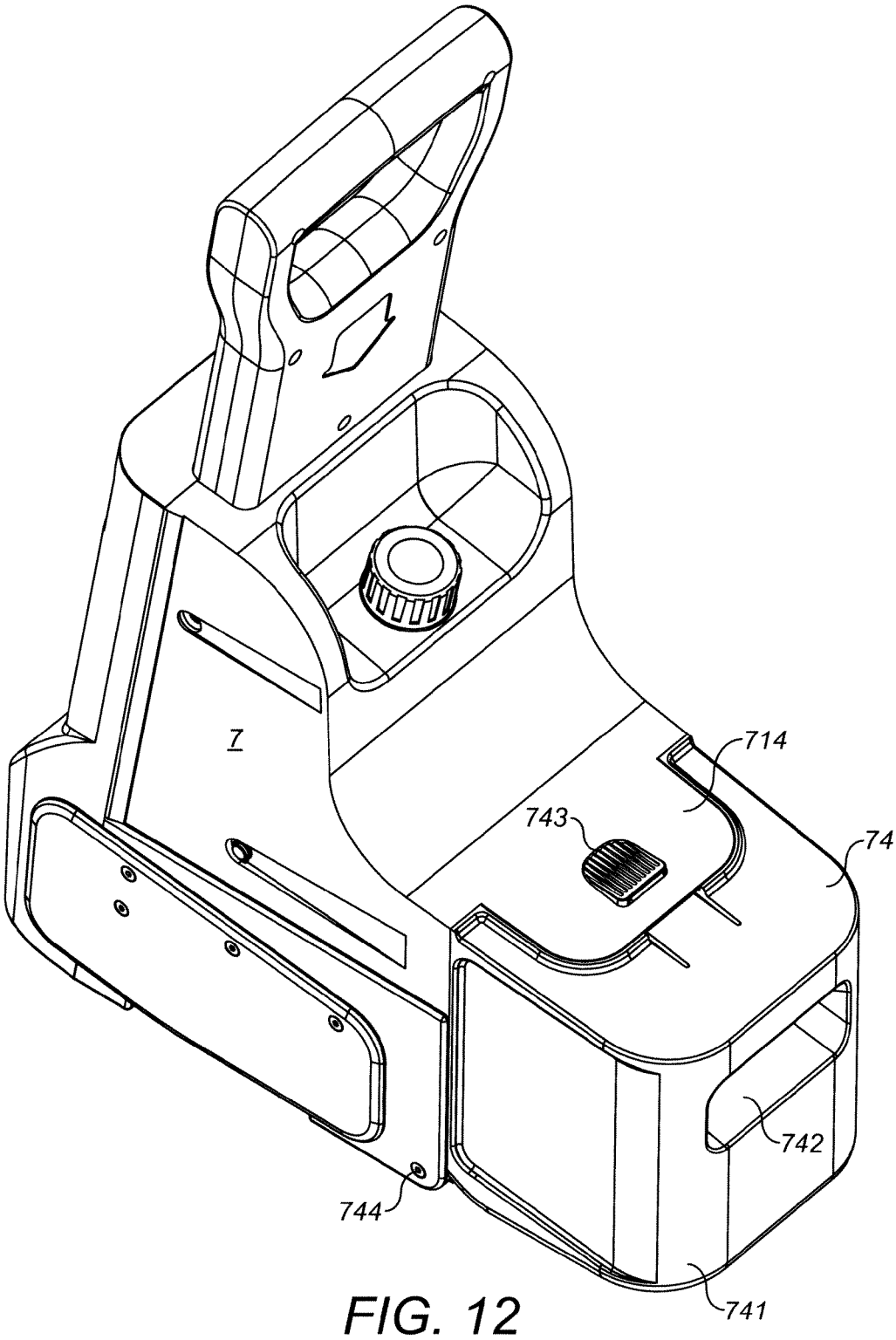
FIG. 12 shows the exterior of the present nvention connected to the collection chamber of the present invention.

FIG. 12 illustrates the outside of the waste removal device 7 with the collection chamber 74 attached. The collection chamber 74 has a hollow body 741, arranged to receive waste delivered to it from the area to be cleaned. A cavity 742 is provided to allow the fingers of a user to enter the cavity and grip the collection chamber for removal from the body of the waste removal device. This function is provided so that once the collection chamber is full, the chamber can be removed for emptying. A button 743 may be provided to release at least an upper portion of the collection chamber from the body of the waste collection device. The collection chamber may be arranged to pivot around a collection chamber pivot point 744 once the upper portion has been released. The button 743 is arranged to engage with a collection chamber engagement portion 714 provided on the body of the waste removal device.

Figure 13:
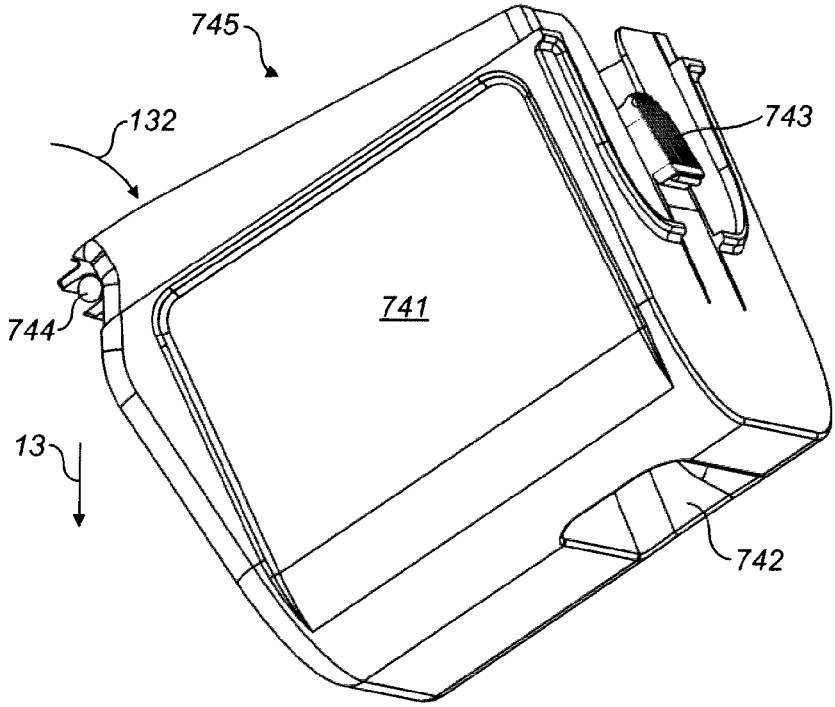
FIG. 13 shows the collection chamber tilted at an angle for the removal of waste.

FIG. 13 shows a possible orientation of the collection chamber 74 when button 743 has been disengaged from collection chamber engagement portion 714. The collection chamber may tilt away from the body 71 to an angle of around 35 degrees. Due to gravity acting downwards, substantially in the direction of arrow 13 in FIG. 13, waste in the collection chamber is maintained within the collection chamber. A removable bag may be provided to line the collection chamber such that the waste can be easily removed without requiring contact between the user and the waste. Collection chamber pivot point 744 may remain attached to the body 71 of the device such that the collection chamber pivots away from the body in a direction of arrow 132. The collection chamber comprises an opening 745 arranged such that when the collection chamber is connected to the waste removal device the opening 745 is oriented towards the area to be cleaned and towards the paddle of the waste removal device.

Figure 14:
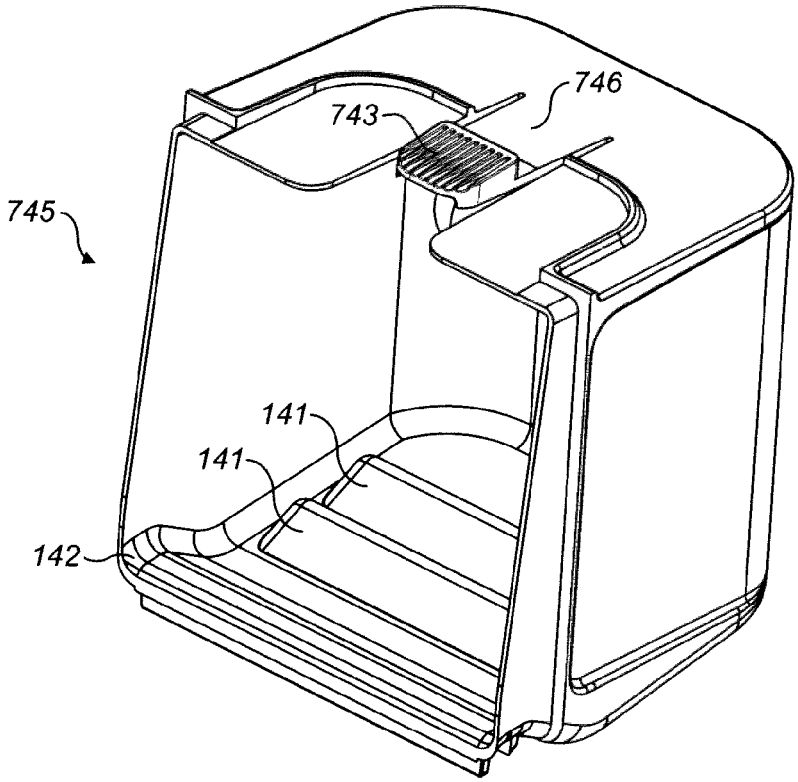
FIG. 14 shows a perspective view of external and internal features of the collection chamber.

FIG. 14 shows the interior of the collection chamber. The bottom of the collection chamber comprises a plurality of ridges 141 which are arranged to prevent waste from slipping back toward the area to be cleaned after it has been delivered to the collection chamber. A raised lip 142 is also provided, which corresponds substantially with lip 711 of body 71, illustrated in FIGS. 8 and 9. Raised lip 141 can also help to prevent waste from falling back to the area to be cleaned after being delivered to the collection chamber. A bag may be placed in the collection chamber with a bag opening arranged to correspond with the outer edges of opening 745. The outer extremities of the bag may be pulled back over the edges of opening 745 to ensure that all waste directed towards the collection chamber by the device enters the bag. Engagement means, optionally in the form of a button 743 may be provided. The button 743 may be provided on a biasing element 746, such that button 743 may be depressed to disengage the engagement means from the collection chamber engagement portion 714 of body 71. Any other releasable engagement means may be used in placed of button 743 and biasing member 746.

Figure 15:
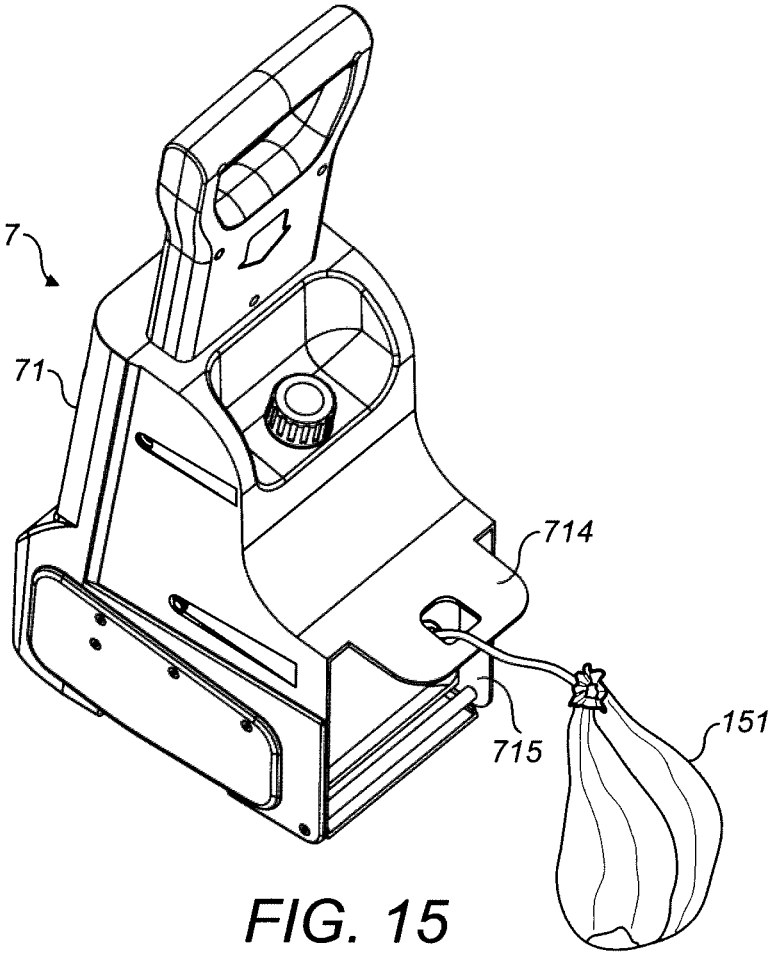
FIG. 15 shows a perspective view of the exterior of the present invention with the collection chamber removed.

FIG. 15 shows the body 71 of pet waste removal device 7 without the collection chamber 74 attached. A collection chamber opening 715 is shown, which allows waste to be delivered from the area to be cleaned 73 into the collection chamber 74 by the paddle 72 (not shown in FIG. 15).

A removable drawstring bag 151 may be provided in collection chamber 74, with the drawstring attached to body 71, optionally via collection chamber engagement portion 714, such that when the collection chamber is released from body 71, the drawstring is automatically drawn to close the bag without a requirement for direct contact between the open bag and the user. Gravity acting on the waste in the bag will tend to draw the bag away from body 71 as collection chamber 74 is moved away from body 71, resulting in the drawstring being drawn.

Figure 16:
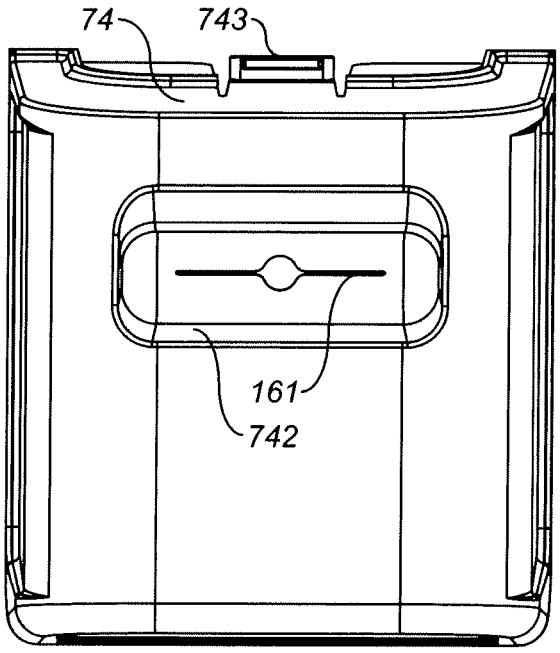
FIG. 16 shows an external view of a closed end of the collection chamber.

FIG. 16 shows an optional bag engagement portion 161, which may take the form of a slit, thought which a portion of the bag may be drawn to engage the bag with the interior of the collection chamber 74. The slit may be provided in the cavity 742 or in any other part of the collection chamber 74. The slit may be an opening in the collection chamber, which permits the user to see from the outside of the collection chamber whether a bag is inside the collection chamber. The opening may be located remotely and/or separately from the cavity 742.

In an alternative embodiment, the device may be docked in or with a tank or separate bin, which may be submerged in a user's garden, thus requiring no contact with the waste in the device and requiring no bag and no transfer of the waste to a dustbin by a user.

The invention claimed is:

1. A pet waste removal device comprising:

a body;

a movable paddle operably mounted with the body;

a collection chamber positioned to receive waste delivered by movement of the paddle;

a paddle driving arrangement operably mounted on the body and configured to drive the paddle to cause said movement of the paddle to remove waste from an area to be cleaned and deliver it to the collection chamber; and a fluid delivery device engageable by the paddle driving arrangement to deliver a fluid to the area to be cleaned, wherein said paddle driving arrangement is operably coupled with both the paddle and the fluid delivery device so that when the paddle driving arrangement drives the paddle to remove waste from the area to be cleaned and deliver it to the collection chamber it also engages the fluid delivery device to cause the fluid delivery device to deliver fluid to the area to be cleaned;

wherein the paddle is arranged to be driven through a stroke from a first point to a second point, passing over the area to be cleaned; and wherein the stroke comprises: a first part, along which an edge of the paddle nearest to the area to be cleaned travels substantially parallel to the area to be cleaned; and a second part along which an edge of the paddle nearest to the area to be cleaned travels away from the area to be cleaned to lift waste away from the area to be cleaned.

2. The pet waste removal device according to claim 1, wherein the paddle driving arrangement is a mechanism.

3. The pet waste removal device according to claim 2, wherein the mechanism is a lever arranged to drive the paddle.

4. The pet waste removal device according to claim 3, wherein the lever is attached relative to both the paddle and the fluid delivery device so that movement of the lever causes both said movement of the paddle and said engagement of the fluid delivery device.

5. The pet waste removal device according to claim 1, wherein the fluid delivery device is arranged to deliver fluid to the paddle and to the area to be cleaned.

6. The pet waste removal device according to claim 1, further comprising an enclosure arranged to be placed over the area to be cleaned during operation of the paddle and/or the liquid fluid delivery device.

7. The pet waste removal device according to claim 1, wherein the body comprises an opening defining the area to be cleaned.

8. The pet waste removal device according to claim 1, further comprising a secondary cleaning portion, arranged to follow the paddle to remove additional waste from the area to be cleaned.

9. The pet waste removal device according to claim 1, wherein driving the paddle induces a scooping effect to lift said waste from the area to be cleaned.

10. The pet waste removal device according to claim 9, wherein the scooping effect comprises a combination of linear movement and rotational movement of the paddle.

11. The pet waste removal device according to claim 10, wherein the paddle includes a protrusion to engage with the pathway(s).

12. The pet waste removal device according to claim 11, wherein the paddle includes first and second protrusions arranged to engage the first and second pathways, respectively.

13. The pet waste removal device according to claim 10, further comprising a first pathway, and a second pathway arranged between the first pathway and the area to be cleaned.

14. The pet waste removal device according to claim 9, wherein the paddle is driven along at least one pathway arranged to create the scooping effect.

15. The pet waste removal device according to claim 1, wherein the stroke comprises a stage in which the edge of the paddle nearest to the area to be cleaned approaches the area to be cleaned.

* * * * *